US007423228B1

(12) United States Patent
White et al.

(10) Patent No.: US 7,423,228 B1
(45) Date of Patent: Sep. 9, 2008

(54) APPARATUS FOR OPENING AN ELECTRICAL SWITCH RESPONSIVE TO SEISMIC OR OTHER EVENT

(76) Inventors: Richard C. White, 6985 Kona Dr., Placerville, CA (US) 95667; Cheryl M. Johnson, 6985 Kona Dr., Placerville, CA (US) 95667

( * ) Notice: Subject to any disclaimer, the term of this patent is extended or adjusted under 35 U.S.C. 154(b) by 0 days.

(21) Appl. No.: 11/881,053

(22) Filed: Jul. 25, 2007

(51) Int. Cl.
*H01H 35/14* (2006.01)

(52) U.S. Cl. ..... 200/61.45 R; 200/61.52

(58) Field of Classification Search ..... 200/61.45 R–61.53, 573, 574, 318–326, 329, 330, 332
See application file for complete search history.

(56) References Cited

U.S. PATENT DOCUMENTS

| | | | | |
|---|---|---|---|---|
| 893,997 | A | 7/1908 | Haas et al. | |
| 1,650,968 | A | 11/1927 | Tedeschi | |
| 3,714,456 | A | 1/1973 | Krohmer et al. | |
| 3,779,262 | A | 12/1973 | Manning et al. | |
| 4,191,868 | A | 3/1980 | Sunde | |
| 4,314,120 | A * | 2/1982 | Sharp et al. | 200/61.45 R |
| 4,326,111 | A * | 4/1982 | Jackman | 200/61.45 R |
| 4,359,722 | A | 11/1982 | Valdez et al. | |
| 4,390,922 | A | 6/1983 | Pelliccia | |
| 4,414,994 | A | 11/1983 | Hogan | |
| 4,833,461 | A | 5/1989 | Yeager | |
| 4,841,287 | A | 6/1989 | Flig et al. | |
| 4,903,720 | A * | 2/1990 | McGill | 200/61.45 R |
| 5,436,416 | A * | 7/1995 | Fletcher | 200/61.45 R |
| 5,590,718 | A * | 1/1997 | Bertossi | 200/61.45 R |
| 5,596,183 | A * | 1/1997 | Haley | 200/61.45 R |
| 5,633,463 | A * | 5/1997 | Szasz | 200/61.45 R |
| 6,034,614 | A * | 3/2000 | Haley | 200/61.52 |
| 6,414,601 | B1 | 7/2002 | Massedonio | |
| 6,917,004 | B1 * | 7/2005 | Engdahl | 200/61.45 R |

FOREIGN PATENT DOCUMENTS

| | | |
|---|---|---|
| JP | 0432212 | 11/1992 |
| JP | 0831571 | 11/1996 |
| JP | 091806 | 7/1997 |
| JP | 093204 | 12/1997 |
| JP | 1108907 | 3/1999 |

* cited by examiner

*Primary Examiner*—Michael A Friedhofer
(74) *Attorney, Agent, or Firm*—Thomas R. Lampe

(57) ABSTRACT

Mechanical apparatus is connected to an electrical switch having an on/off button, the apparatus including a button contact member which engages the on/off button and is latched to maintain the button in on position. Unlatching structure including a pendulum and lever unlatches the button contact member in the event of a seismic or other event applying a force to the apparatus.

15 Claims, 4 Drawing Sheets

APPARATUS FOR OPENING AN ELECTRICAL SWITCH RESPONSIVE TO SEISMIC OR OTHER EVENT

TECHNICAL FIELD

This invention relates to apparatus employed with an electrical switch including an on/off button for opening the switch responsive to occurrence of a seismic or other event applying a force to the apparatus.

BACKGROUND OF THE INVENTION

It is known generally to automatically disable utility service supplied to a building responsive to an earthquake. Such devices are typically relatively complex and expensive and utilize electrical power to operate. Installation can be time consuming and expensive.

The following patent documents are believed to be representative of the current state of the art in this field: U.S. Pat. No. 4,390,922, issued Jun. 28, 1983, U.S. Pat. No. 4,359,722, issued Nov. 16, 1982, U.S. Pat. No.5,436,416, issued Jul. 25, 1995, U.S. Pat. No. 4,191,868, issued Mar. 4, 1980, U.S. Pat. No. 3,779,262, issued Dec. 18, 1973, U.S. Pat. No. 1,650,968, issued Nov. 29, 1927, U.S. Pat. No. 893,997, issued Jul. 21, 1908, U.S. Pat. No. 4,841,287, issued Jun. 20, 1989, U.S. Pat. No. 4,414,994, issued Nov. 15, 1983, U.S. Pat. No. 4,833,461, issued May 23, 1989, U.S. Pat. No. 3,714,456, issued Jan. 30, 1973, U.S. Pat. No. 6,414,601, issued Jul. 2, 2002, Japanese Patent No. 11089078, issued Mar. 30, 1999, Japanese Patent No. 09320418, issued Dec. 12, 1997, Japanese Patent No. 09180619, issued Jul. 11, 1997, Japanese Patent No. 08315710, issued Nov. 29, 1996 and Japanese Patent No. 04322120, issued Nov. 12, 1992.

DISCLOSURE OF INVENTION

The apparatus of the present invention is wholly mechanical in nature. It is highly reliable and relatively inexpensive. The apparatus is of unitary construction and is readily attached in place and employed with a standard electrical switch including a switch box and an on/off button projecting from said switch box. An example is a single gang electrical box of the type commonly employed with master switches in houses and other buildings.

The apparatus of the invention is for opening the switch responsive to occurrence of a seismic or other event applying a force to the apparatus. Examples of other events that could trigger opening of the switch by the apparatus is building movement caused by hurricanes, tornados and floods.

The apparatus includes a support adjacent to the switch. A button contact member is movably mounted on the support engaging the on/off button of the switch.

Biasing structure urges the button contact member in a predetermined direction either toward or away from the switch, the button contact member being latched against movement relative to the switch.

The apparatus further includes unlatching structure responsive to occurrence of a seismic or other event applying a force to the apparatus to unlatch the button contact member and allow movement of the button contact member by the biasing structure in the predetermined direction to cause movement of the actuator button and opening of the switch.

Other features, advantages and objects of the present invention will become apparent with reference to the following description and accompanying drawings.

MODES FOR CARRYING OUT THE INVENTION

Figure 1:
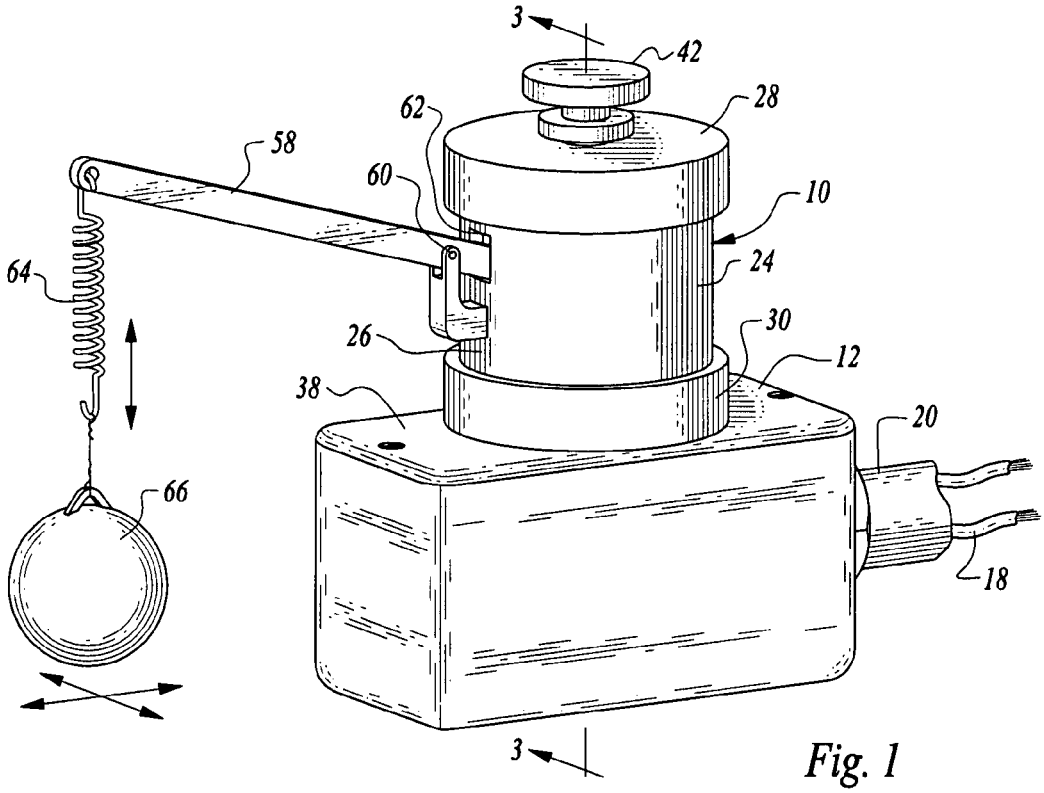
FIG. 1 is a perspective view of a first embodiment of apparatus constructed in accordance with the teachings of the present invention mounted on a switch box.

Referring now to FIGS. 1-5, a first embodiment 10 of apparatus constructed in accordance with the teachings of the present invention is shown mounted on the switch box 12 of a standard electrical switch 14 having an on/off push button 16. Wiring 18 extends from the switch outwardly through the box into electrical conduit 20.

Apparatus 10 may readily be mounted on a switch box that is already in place. Installation is fast and inexpensive. Since the apparatus is wholly mechanical in nature and does not require wiring, a high degree of skill is not required to install it. The apparatus includes a support 24 including a cylindrically-shaped body 26, an upper end cap 28 and a lower end cap 30. The lower end cap defines an opening 32 through which a threaded boss 34 of the switch accommodating on/off push button 16 projects. A cylindrically-shaped guide member 36 threaded at its lower end is threaded onto boss 34 and secures the lower end cap to the top plate 38 of the switch box. Cylindrically-shaped body 26 is positioned in the lower end cap and may be secured thereto in any desired manner.

Passing through an opening 40 of upper end cap 28 is an elongated button contact member 42. When the apparatus of the invention is installed, the lower or distal end 44 of the button contact member engages push button 16. The distal end is located within the confines of guide member 36 which aligns the distal end with the on/off button.

The elongated button contact member includes two segments 46, 48 which are threadedly engaged. Lower segment 48 is rounded and directly engages the button 16. The overall length of the button contact member can be adjusted or changed simply by relatively rotating the segments 46, 48.

Figure 3:
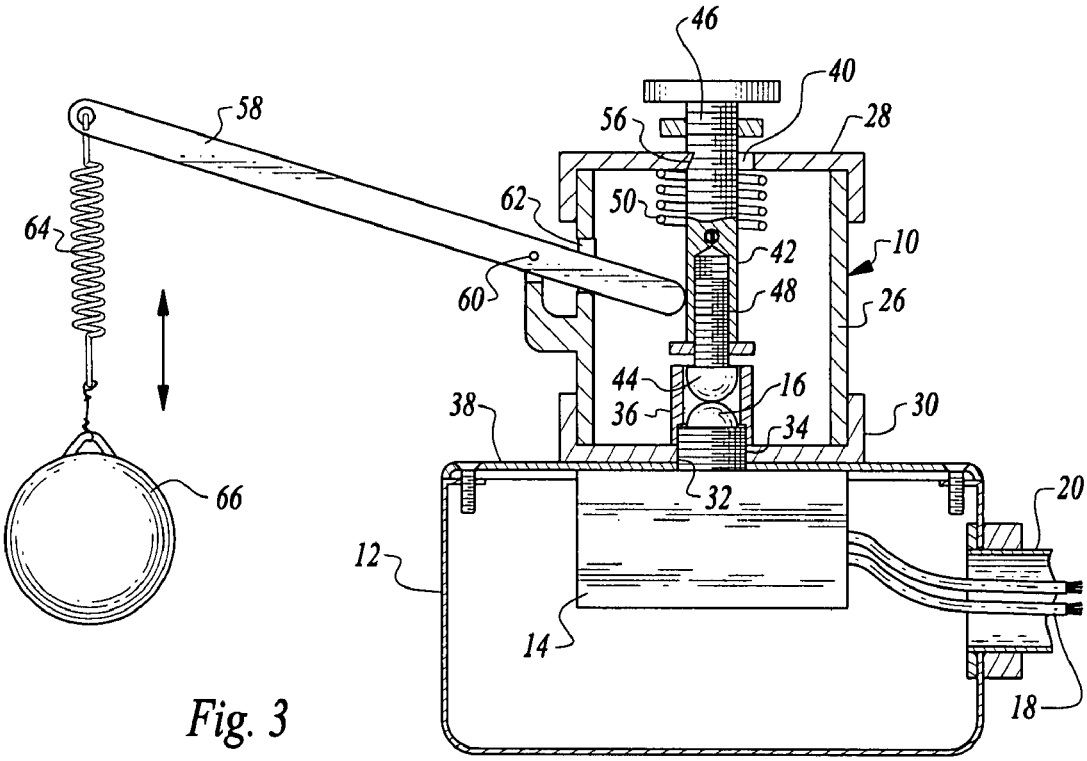
FIG. 3 is a cross-sectional view taken along the line 3-3 in FIG. 1 and showing the relative positions assumed by structural components of the apparatus and switch when the switch is closed.

A coil compression spring 50 surrounds the button contact member. The lower end of the spring is secured to upper segment 46 by a cotter pin 52 passing therethrough. The upper end of the coil compression spring bears against upper end cap 28. Thus, a downwardly directed biasing force is always exerted on the button contact member. FIGS. 1 and 3 show the condition of the button contact member when it is in its latched or upper position and not applying a downward force on the push button 16. In the type of switch illustrated, the push button is disposed in its uppermost position when the switch is closed. That is, with this particular type of switch, the button 16 must be depressed to open the switch.

Figure 2:
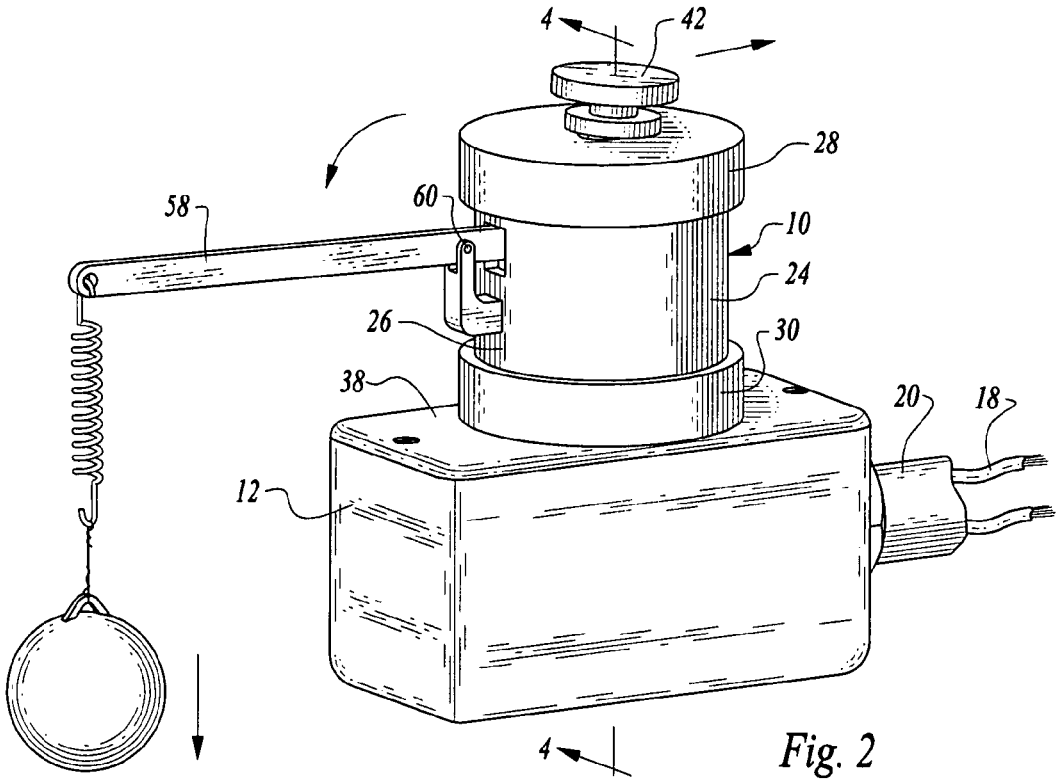
FIG. 2 is a view similar to FIG. 1, showing the condition of the apparatus after or during occurrence of a seismic or other event applying force to the apparatus to open the switch.

The button contact member is maintained in the position illustrated in FIGS. 1 and 2 by latching structure consisting of a notch 54 defined by the button contact member which receives a portion 56 of the upper end cap 30 defining opening 40.

The apparatus includes unlatching structure responsive to occurrence of a seismic or other event applying force to the apparatus to unlatch the button contact member and allow movement of the button contact member by the spring 50 in a downward direction to cause downward movement of the button and opening of switch 14.

More particularly, the unlatching structure includes an elongated lever 58 mounted on support 24 for pivotal movement relative thereto about a pivot point 60. The lever extends through an opening 62 in cylindrically-shaped body 26 and the inner end of the lever engages a side of the button contact member. A coil tension spring 64 extends downwardly from the other end of the lever on the other side of the pivot point. A weight comprising a pendulum 66 is suspended by the spring 64.

Figure 4:
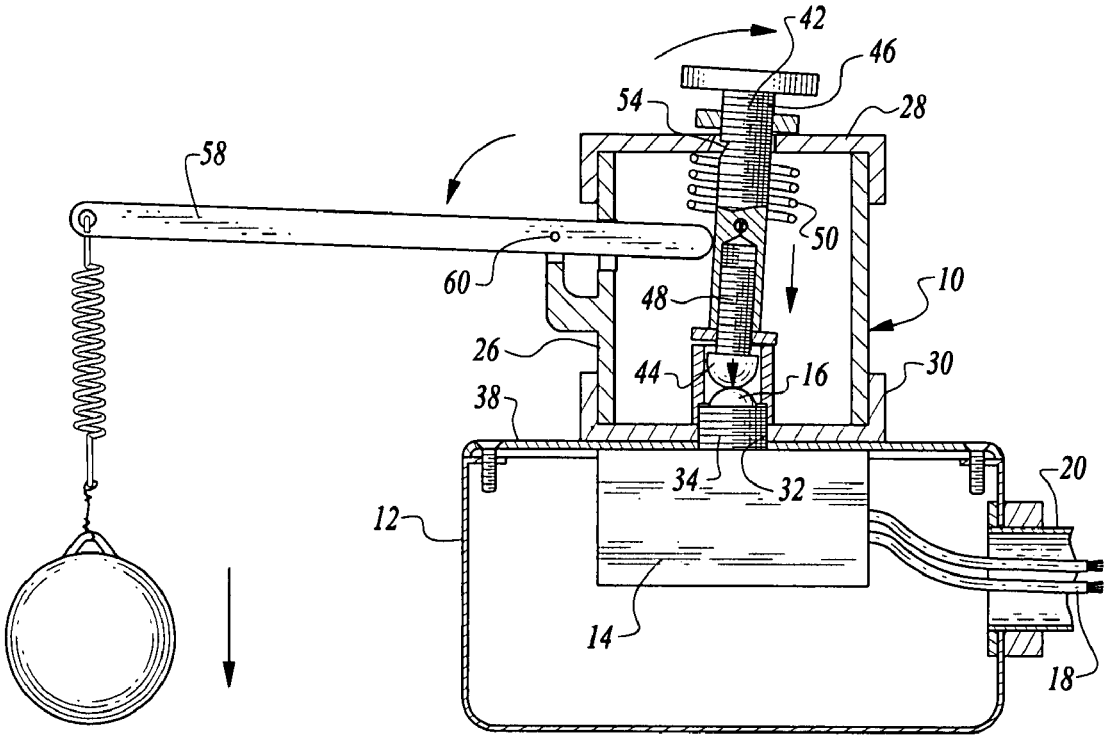
FIG. 4 is a cross-sectional view taken along the line 4-4 of FIG. 2 showing the condition of the structural elements of the apparatus and switch during or after a seismic or other event applying force to the apparatus wherein the push button is depressed and the switch is open.

FIGS. 2 and 4 illustrate the state of the apparatus and switch after a seismic or other event applies a force of sufficient magnitude to the apparatus to trigger the apparatus and cause the apparatus to open the switch 14. The spring 64 and pendulum 66 actually serve to multiply the effect of such forces and cause the lever 58 to pivot from the position shown in FIG. 3 to FIG. 4 which in turn displaces the button contact member laterally and causes the notch 54 to be moved away from portion 56. The button contact member is tilted about the location of engagement between the lower or distal end 44 thereof and the button 16. The coil compression spring 50 then urges the button contact member downwardly to depress the button 16 and open the switch 14.

Figure 6:
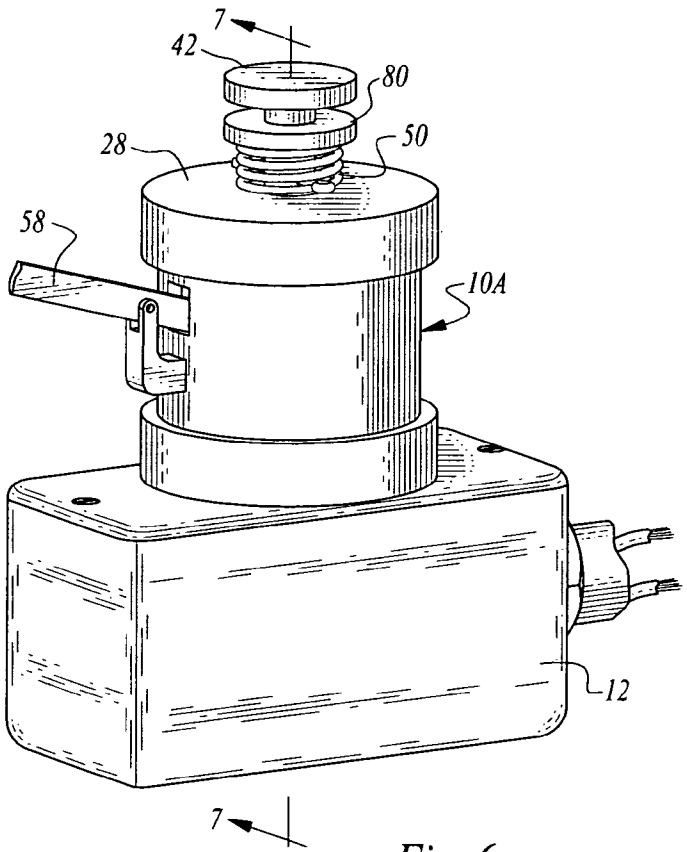
FIG. 6 is a perspective view illustrating a second embodiment of apparatus employed with a different type of switch.
Figure 5:
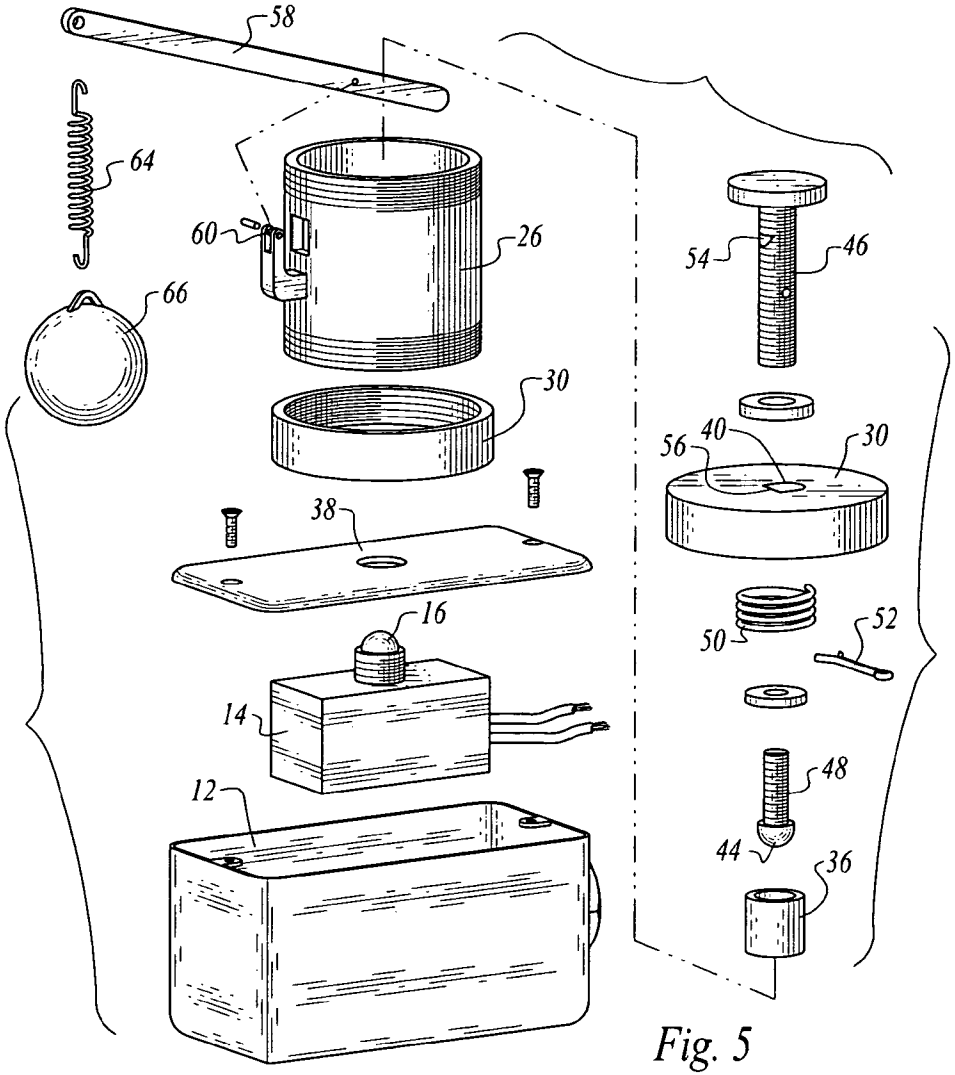
FIG. 5 is an exploded, perspective view illustrating the components of the apparatus and switch in the FIG. 1 embodiment.
Figure 7:
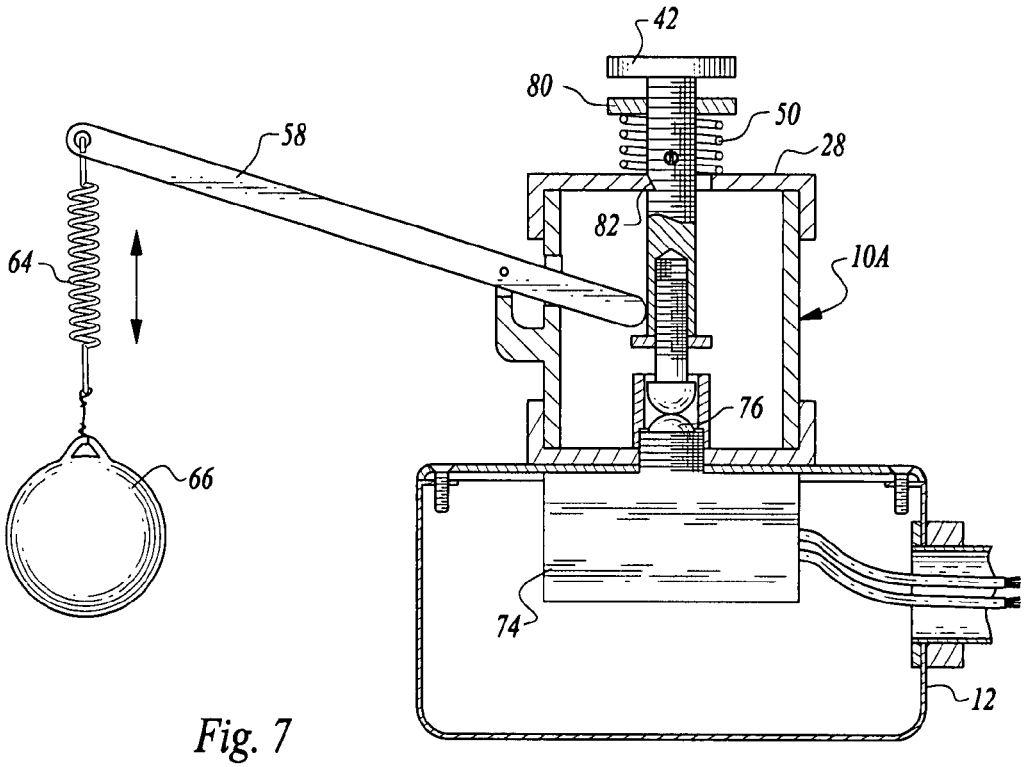
FIG. 7 is a view taken alone line 7-7 of FIG. 6 illustrating the structural elements of the second embodiment when the switch on which it is mounted is closed.
Figure 8:
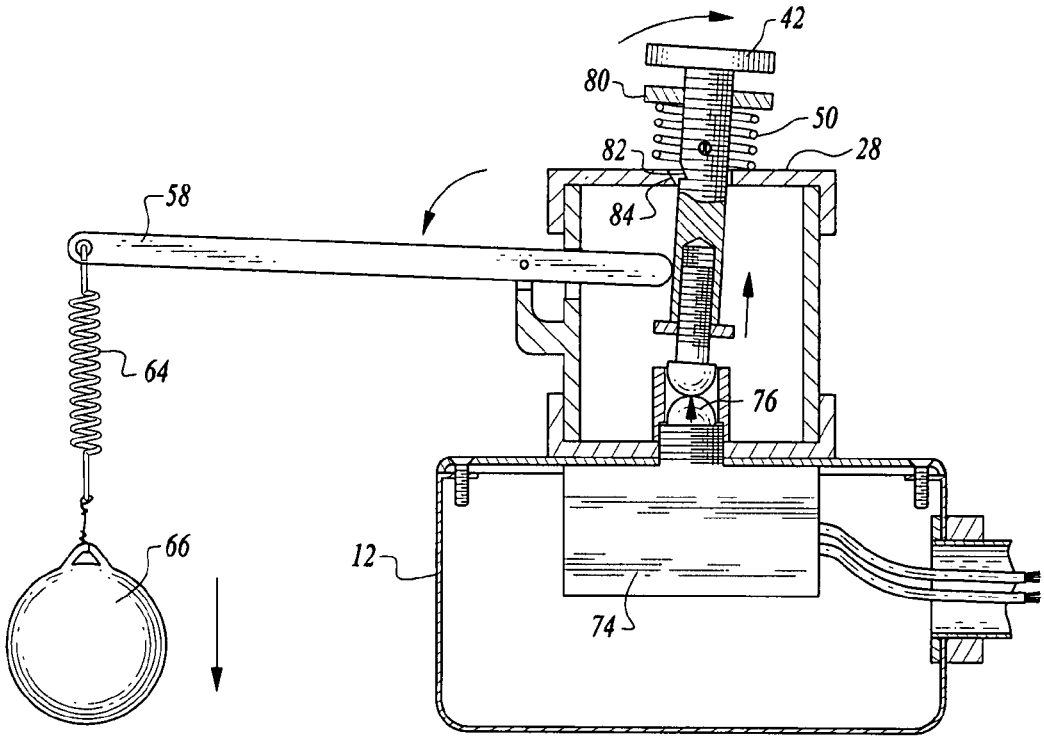
FIG. 8 is a view similar to FIG. 7, but illustrating the structural components of the second embodiment and switch after or during occurrence of a seismic or other event and the switch has been opened.

FIGS. 6-8 illustrate a second embodiment of the invention. The apparatus 10A is for the most part identical to the apparatus 10 and like reference numbers are employed are designate like structural components. The apparatus 10A is for use with a switch 74 differing from previously described switch 14 only in that the push button 76 thereof is normally depressed (as shown in FIG. 7) when the switch 74 is closed.

In this form of the apparatus, the coil compression spring 50 is positioned above the upper end cap 28 and bears against a threaded washer 80 attached to the upper segment of the button contact member 42. A notch 82 in the button contact member receives a portion 84 of the upper end cap to retain the button contact member and the switch push button 76 in a lowered condition. When, however, the apparatus is actuated as described above and the lever 58 pivots from a position of FIG. 7 to the position of FIG. 8, tilting or lateral displacement of the button contact member will result in the coil compression spring 50 moving the button contact member upwardly away from the switch, allowing the push button to move upwardly and open the switch 74.

The invention claimed is:

1. In combination:

an electrical switch including an on/off button; and apparatus for opening the switch responsive to occurrence of a seismic or other event applying a force to said apparatus, said apparatus including:

a support adjacent to said switch;

a button contact member movably mounted on said support engaging the on/off button of said switch;

biasing structure urging said button contact member in a predetermined direction either toward or away from said switch, said button contact member being latched against movement relative to said switch; and unlatching structure responsive to occurrence of a seismic or other event applying force to the apparatus to unlatch said button contact member and allow movement of said button contact member by said biasing structure in said predetermined direction to cause movement of said actuator button and opening of said switch.

2. The combination according to claim 1 wherein said switch includes a switch box, said support being mounted on said switch box and said on/off button projecting from said switch box.

3. The combination according to claim 1 wherein said button contact member is slidably mounted on said support.

4. The combination according to claim 3 wherein said support engages said button contact member to latch said button contact member against-movement in said predetermined direction.

5. The combination according to claim 4 wherein said button contact member defines a notch receiving a portion of said support to latch said button contact member against movement in said predetermined direction.

6. The combination according to claim 5 wherein said unlatching structure comprises a lever mounted for pivotal movement relative to said support about a pivot point, said lever bearing against said button contact member at a first location on said lever, said apparatus additionally including a weight suspended from said lever at a second location on said lever spaced from said pivot point, said first and second locations being on opposite sides of said pivot point.

7. The combination according to claim 6 wherein said weight comprises a pendulum suspended by a spring extending downwardly from said lever.

8. The combination according to claim 7 wherein said pendulum is responsive to a force applied to said apparatus by a seismic or other event to cause said lever to displace said button contact member laterally relative to said predetermined direction and to cause said notch to be moved away from said portion of said support.

9. The combination according to claim 8 wherein said button contact member has a distal end engaging said on/off button, said apparatus including a guide member aligning said distal end with said on/off button.

10. The combination according to claim 1 wherein said biasing structure comprises a spring between said button contact member and said support.

11. The combination according to claim 1 wherein said biasing structure urges said button contact member toward said switch.

12. The combination according to claim 1 wherein said biasing structure urges said button contact member away from said switch.

13. The combination according to claim 1 wherein said button contact member is elongated and includes two button contact member segments adjustably movable relative to one another to change the overall length of said button contact member.

14. The combination according to claim 9 wherein said button contact member is tiltably mounted in said support, said lever tilting said button contact member about the location of engagement between said distal end and said on/off button.

15. The combination according to claim 6 wherein said pivot point is located on said support.

* * * * *